US006845518B1

(12) United States Patent
Boesen

(10) Patent No.: US 6,845,518 B1
(45) Date of Patent: Jan. 25, 2005

(54) REVERSIBLE STADIUM COAT

(76) Inventor: Connie J. Boesen, 801 Bertch Ave., Waterloo, IA (US) 50702

( * ) Notice: Subject to any disclaimer, the term of this patent is extended or adjusted under 35 U.S.C. 154(b) by 0 days.

(21) Appl. No.: 10/679,066

(22) Filed: Oct. 3, 2003

(51) Int. Cl.[7] ..... A41D 15/04
(52) U.S. Cl. ..... 2/86; 2/94; 224/577
(58) Field of Search ..... 2/85–94, 69, 69.5, 2/108, 115, 247, 244, 102, DIG. 2; 224/587, 153, 191, 230, 577

(56) References Cited

U.S. PATENT DOCUMENTS 4,138,742 A 2/1979 Meeks
4,272,852 A * 6/1981 Bell ..... 2/94
4,307,470 A * 12/1981 Ezell ..... 2/108
4,389,735 A * 6/1983 McLaughlin ..... 2/94
4,475,251 A * 10/1984 Hopkins ..... 2/94
4,502,155 A * 3/1985 Itoi ..... 2/115
4,563,776 A * 1/1986 Boesen ..... 2/85
4,563,777 A * 1/1986 Park ..... 2/108
4,752,971 A * 6/1988 Meserol ..... 2/88
4,862,520 A * 9/1989 Gazzola ..... 2/85
4,932,574 A * 6/1990 Doshi ..... 224/153
5,407,112 A * 4/1995 Christodoulou et al. .... 224/153
5,724,672 A * 3/1998 Chen ..... 2/69
5,860,164 A * 1/1999 Johnson ..... 2/94
5,893,502 A * 4/1999 Redzisz ..... 224/577
5,946,723 A 9/1999 DiPrato
5,996,121 A * 12/1999 Harris ..... 2/69
6,061,831 A * 5/2000 Rudolph et al. ..... 2/69.5
6,275,993 B1 8/2001 McCarley
6,345,393 B1 * 2/2002 Bayer ..... 2/94
6,385,775 B1 * 5/2002 Komjati ..... 2/86
6,564,388 B1 * 5/2003 Poston ..... 2/86
2002/0088048 A1 * 7/2002 Turner ..... 2/93

* cited by examiner

*Primary Examiner*—John J. Calvert
*Assistant Examiner*—Alissa L. Hoey
(74) *Attorney, Agent, or Firm*—Sturm & Fix LLP

(57) ABSTRACT

Weather and outdoor temperature are variable. When one spends time outdoors in such activities as observing spectator sports, fishing, backpacking, parades, fireworks, etc., one may need to be prepared for changing temperatures, rain, and other weather variables. A stadium jacket or coat, convertible to a cushion and reversible for variation may be the answer for many of these outdoor activities. With a removable handle, useable regardless of which side of the coat is exposed when in the form of a cushion, the coat or jacket may be easily carried. A handy pocket in the handle may be used for cash, keys, sporting event tickets, etc.

15 Claims, 6 Drawing Sheets

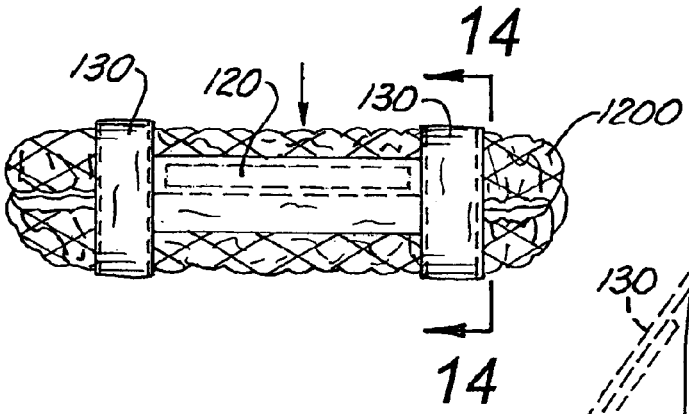
Fig. 13
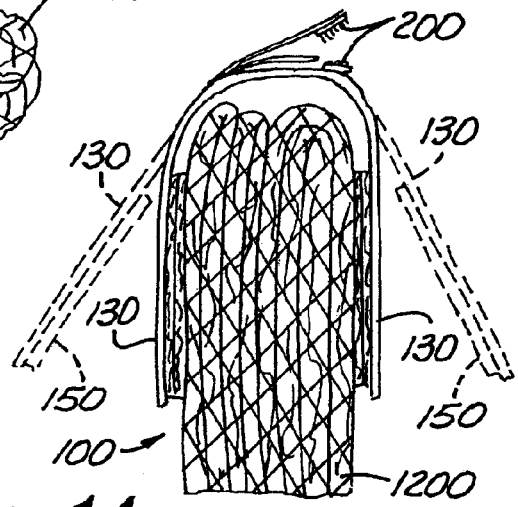
Fig. 14
Fig. 15
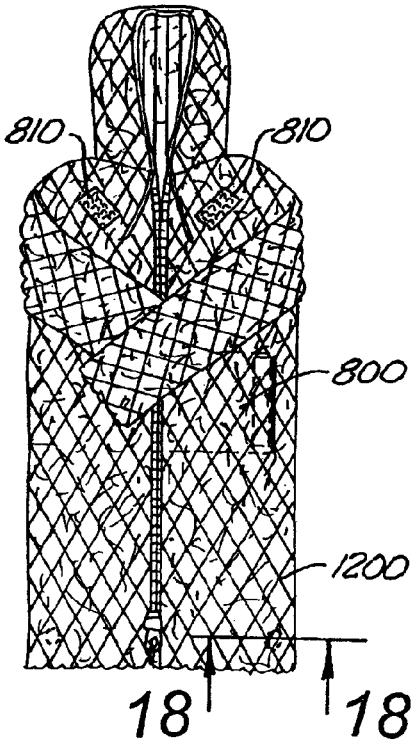
Fig. 16
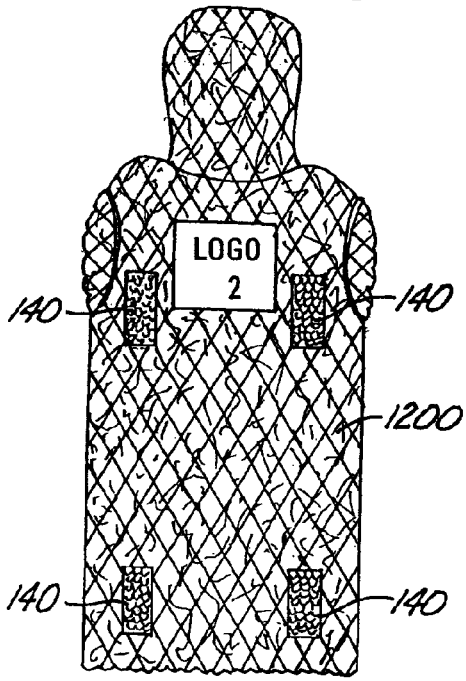

REVERSIBLE STADIUM COAT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates generally to a folding coat. More particularly the present invention relates such a coat which is reversible and convertible to a cushion with a handle useable on the cushion regardless of which side of the coat is exposed.

2. Background Art

A challenge in attending football games, fishing trips, picnics, fireworks displays or other events is that the weather may be unpredictable and the temperature changeable, making it is difficult to dress properly for such outdoor events. The weather at the beginning of such event can be warm enough that light clothing is appropriate, and can turn to weather where warmer, heavy or water repellant clothing is appropriate, or vice versa. Consequently, it is conmuon for people to dress inappropriately for such events; or, as a precaution, to take extra clothing just in case the weather turns colder or inclement.

Consequently, it can be readily appreciated that a large quantity of support equipment is often taken to outdoor events at stadiums. Besides the inconvenience of carrying such equipment to and from the stadium, there is a problem of where to store such additional clothes or equipment if it is not being used, since there is little space provided for each person in a crowded stadium.

Stadium seats are also noted for being hard and uncomfortable, so stadium cushions are often taken, especially since such events can last for several hours.

Boesen disclosed such a stadium coat in U.S. Pat. No. 4,563,776, being herein incorporated by reference. The stadium coat of Boesen '776 does not disclose a reversible stadium coat. A handle for carrying the garment when folded into a stadium cushion is permanently attached to the back of the coat. Hook and loop fasteners are used to attach the front of the handle to the front of the coat when it is worn as a coat. The same fastener on the handle can fasten to the bottom of the coat when the coat is converted into a stadium cushion.

There is therefore a need for a reversible coat or jacket, convertible to a stadium cushion with a handle for carrying the cushion.

BRIEF SUMMARY OF THE INVENTION

The present invention relates to a garment such as a coat oriacket that is reversible. Being reversible, the garment has a first surface and a second surface, either of which may be on the outside of the garment when worn.

The garment of the present invention has a front, back, sides, top and an open bottom. The top has closed shoulders thereon and an opening therebetween for receiving a person's head.

The handle of the present invention is used to carry the garment when the garment is forded into the stadium cushion form. A pair of straps for the handle extend over each shoulder. Fasteners are attached to one side of both ends of each of these straps. Pairs of first and second fastener receiving structures are attached to an upper portion of the back of the garment on each of the first and second surfaces of the garment for receiving fasteners from a first end of each of the pair of straps. Pairs of third and fourth fastener receiving structures are attached to a lower portion of the back of the garment on each of the first and second surfaces of the garment for receiving fasteners from the second end of each of the pair of straps. When the fasteners have thus been mated, they hold the coat in a folded position. Pairs of fifth and sixth fastener receiving structures optionally may be attached to a top portion of the front of the coat on each of the first and second surfaces, one just below each shoulder, for receiving fasteners from the second end of each of the pair of straps when the coat is being wom, whereby the handle may be stored unobtrusively while the coat is being worn.

A handle is attached at each end thereof to an intermediate portion of each of the straps for permitting the folded coat to be easily carried from place to place.

An object of the present invention is to provide a reversible coat which is convertible into a sitting cushion. The coat and the cushion can both be used with either the first or the second surface of the coat exposed to the outside.

Another object of the invention is to provide a reversible coat which is convertible into a package easy to carry from place to place and having a handle thereon.

A further object is to provide a carrying handle for a reversible, folding coat which can be used regardless of which surface of the coat is exposed to the outside when in its cushion form.

Still another object is to provide a carrying handle for a reversible, folding coat also having a handy storage pocket for securely storing small items.

Other objects, advantages and novel features of the present invention will become apparent from the following detailed description of the invention when considered in conjunction with the accompanying drawings.

BRIEF DESCRIPTION OF THE SEVERAL VIEWS OF THE DRAWINGS

FIG. 13 is a side elevation view of the reversible, convertible garment in a cushion configuration showing side B exposed;

FIG. 14 is a cross sectional view of the reversible, convertible garment in a cushion configuration showing side B exposed;

FIG. 15 is a front elevation view of the reversible, convertible garment in a jacket/coat configuration showing side B exposed;

FIG. 16 is a rear elevation view of the reversible, convertible garment in a jacket/coat configuration showing side B exposed;

DETAILED DESCRIPTION OF THE INVENTION

Figure 1:
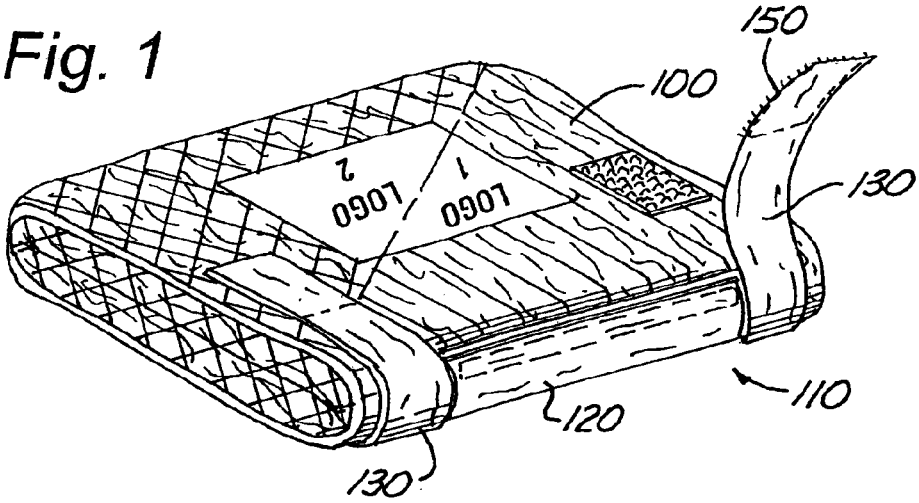
FIG. 1 is a perspective view of a reversible, convertible garment in a cushion configuration.

The reversible garnent of the present invention is shown in its cushion configuration in FIG. 1 and comprises a coat or jacket 100 and a handle 110. A logo may, optionally, be placed on each side of the back of the coat orjacket 100. The logos need not be the sarne. One back surface may be left without a logo, while the other back surface is given a logo.

Figure 3:
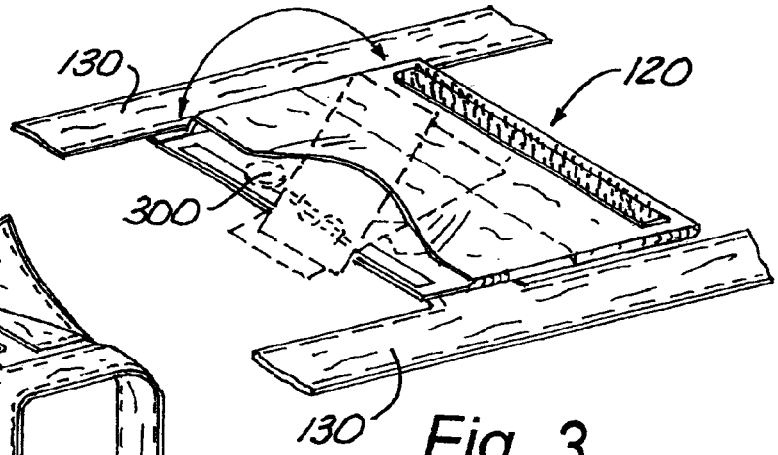
FIG. 3 is a second perspective view of the handle laid flat and showing a compartment therein.
Figure 2:
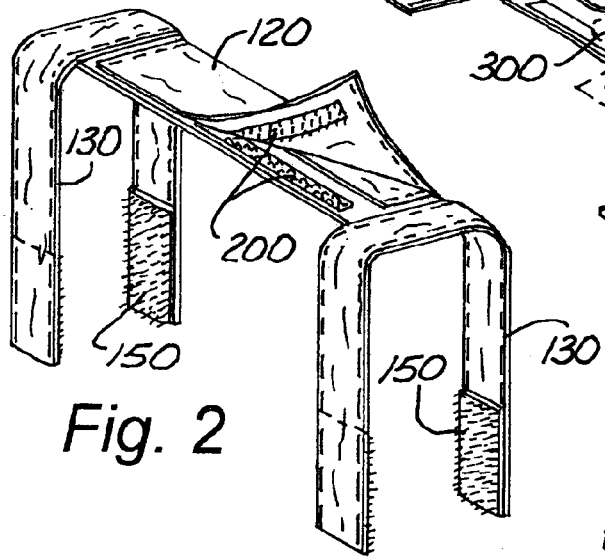
FIG. 2 is a first perspective view of a handle for the reversible, convertible garment when in the cushion configuration.
Figure 4:
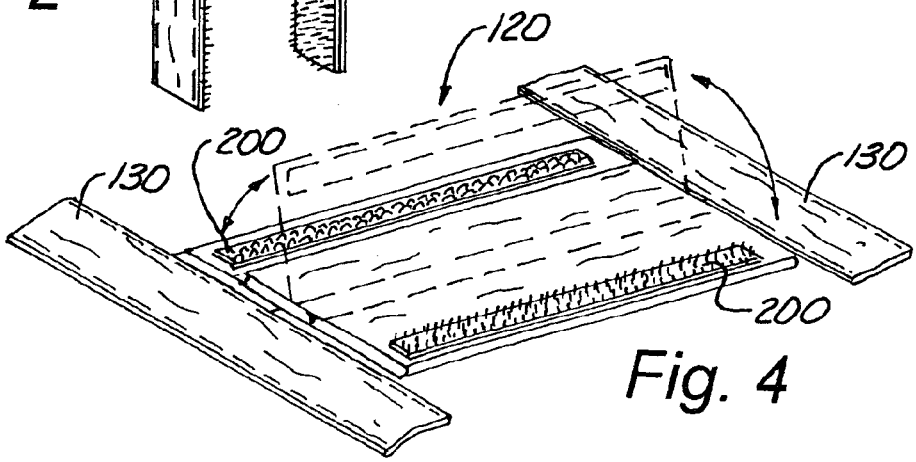
FIG. 4 is a third perspective view of the handle laid flat.

The handle 110 is shown in detail in FIGS. 2–4 and comprises a handle grip 120 and straps 130. The straps 130 are fitted with fasteners, in the preferred embodiment, the hook portion 150 of hook and loop fasteners. The handle grip 120, furthermore, comprises a closable, foldable compartment 300 for securing cash, keys, etc. while the garment is in use. The handle grip 120 is held in its closed, folded configuration by hook and loop fasteners 200.

Figure 5:
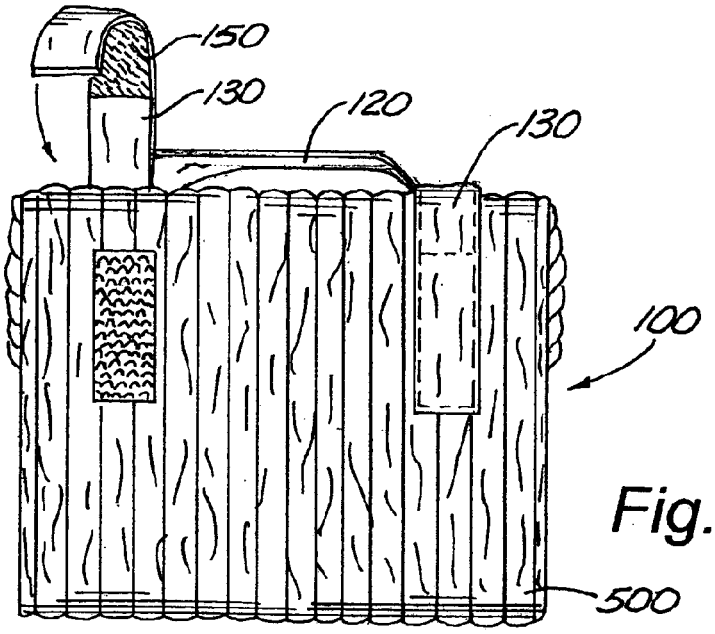
FIG. 5 is a plan view of the reversible, convertible garment in a cushion configuration showing side A exposed.
Figure 6:
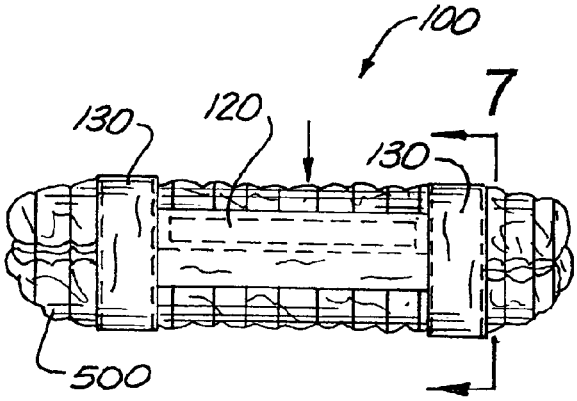
FIG. 6 is a side elevation view of the reversible, convertible garment in a cushion configuration showing side A exposed.
Figure 7:
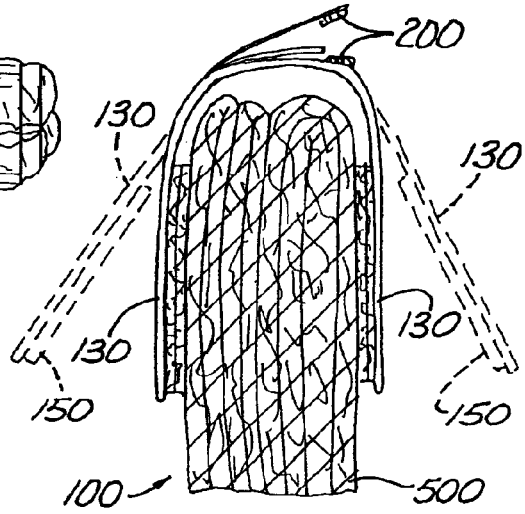
FIG. 7 is a cross sectional view of the reversible, convertible garment in a cushion configuration showing side A exposed.

The garment of the present invention is shown in its cushion configuration in FIGS. 5–7 with side A 500 exposed to the outside of thejacket 100. The jacket or coat 100 is folded into a substantially rectangular parallelepiped shape as shown and the handle 110 affixed using the hook 150 and loop 140 fasteners.

Figure 8:
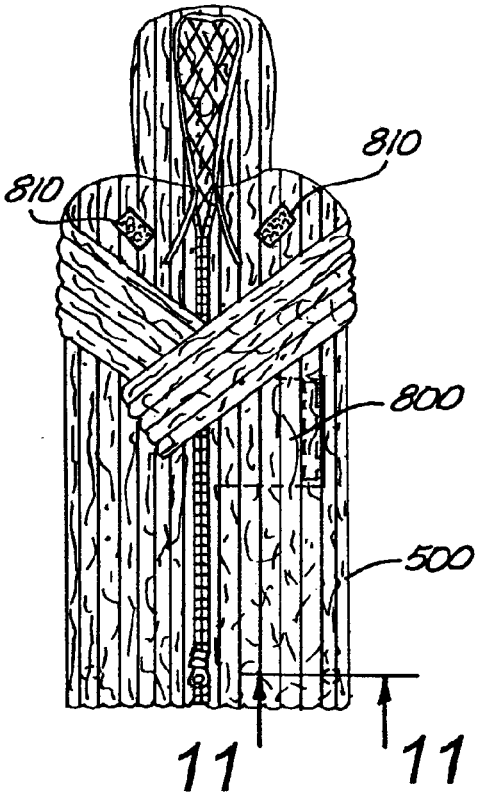
FIG. 8 is a front elevation view of the reversible, convertible garment in a jacket/coat configuration showing side A exposed.
Figure 9:
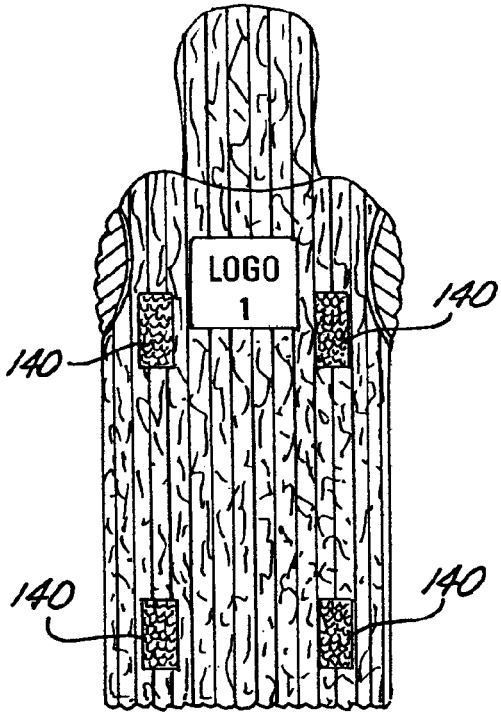
FIG. 9 is a rear elevation view of the reversible, convertible garment in a jacket/coat configuration showing side A exposed.
Figure 10:
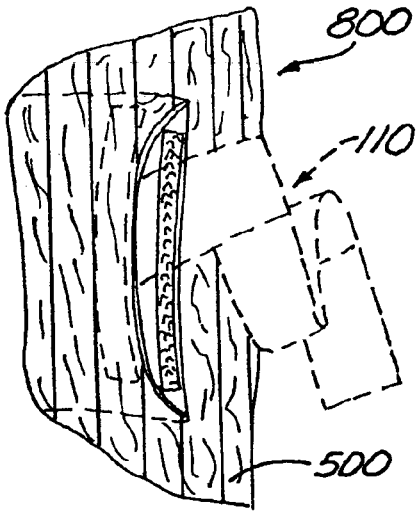
FIG. 10 is a detail view of a pocket with side A exposed of the reversible, convertible garment having the handle stored inside.
Figure 11:
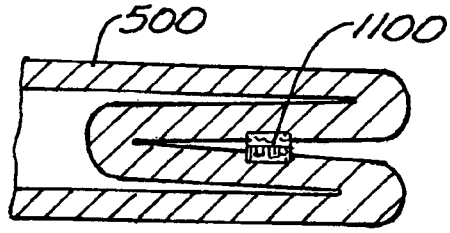
FIG. 11 is a detail view showing side A exposed of a fastener used to hold the reversible, convertible garment in a folded configuration.

The coat or jacket 100 is shown in a semi-folded configuration in FIGS. 8–9 with side A 500 exposed. At least one pocket 800 is included and a particular application thereof is the optional storage of the handle 110 when not in use as shown in FIG. 10 (in FIG. 10, the pocket is shown with side A 500 exposed). Another feature of the jacket or coat 100 are fasteners 1100 as seen in FIG. 11 (jacket folded with side A 500 exposed). The fastener holds a fold in thejacket or coat 100 while the jacket or coat 100 is in the cushion configuration. Acceptable fasteners comprise snaps and hook and loop fasteners.

The rear view of the jacket or coat (FIG. 9) shows the loop portions 140 of the hook and loop fasteners used to attach the handle 110 when the jacket or coat is folded into its cushion configuration. The jacket is folded along a horizontal line halfway between the upper and lower sets of loop fasteners 140, and the straps 130 wrapped around the shoulders and lower edge of the garment 100 to attach the hook fasteners 150 on the handle straps 130 to the loop fasteners 140 on the jacket 100.

Figure 9A:
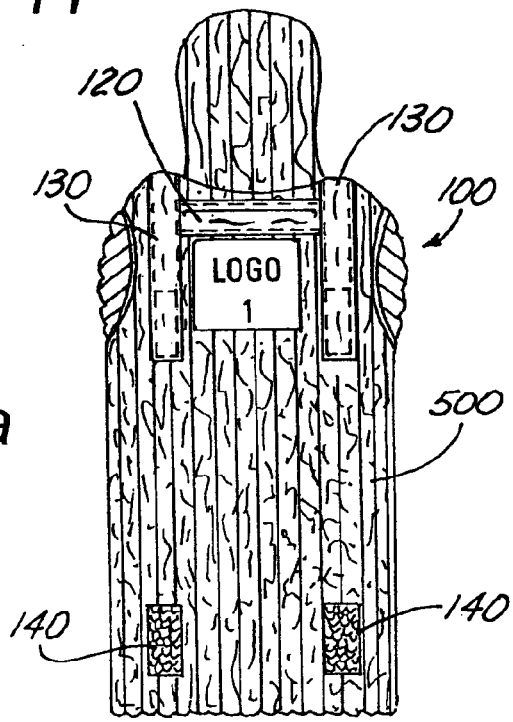
FIG. 9*a* is a rear elevation view of the reversible, convertible garment in a jacket/coat configuration showing side A exposed with the handle stowed at the shoulders.

A second option for stowing the handle 110 when the garment 100 is worn as a coat or jacket is depicted in FIG. 9*a* where it is understood that side A 500 is exposed to the outside. The straps 130 for the handle are attached as usual to the rear fasteners. The other end of the handle straps 130 are attached to front loop fasteners 810 located in the region of the collarbone on the front of the jacket 100.

Figure 12:
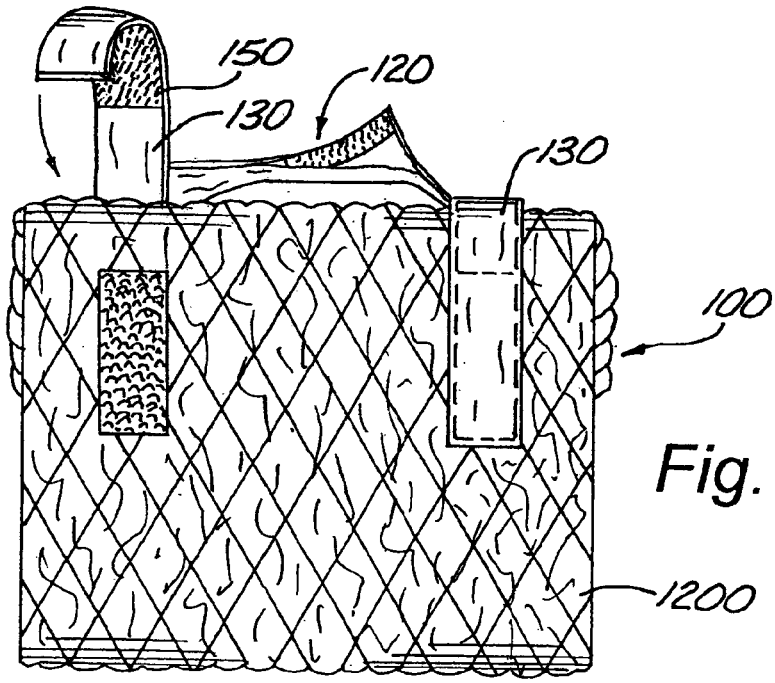
FIG. 12 is a plan view of the reversible, convertible garment in a cushion configuration showing side B exposed.

Because the garment of the present invention is reversible, it is shown in its cushion configuration in FIGS. 12–14 with side B 1200 exposed to the outside of the jacket 100. The jacket or coat 100 is folded into a rectangular parallelepiped shape as shown and the handle 110 affixed using the hook 150 and loop 140 fasteners.

Figure 17:
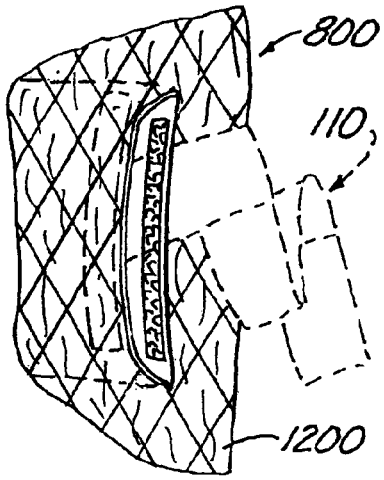
FIG. 17 is a detail view of a pocket with side B exposed of the reversible, convertible garment having the handle stored inside.
Figure 18:
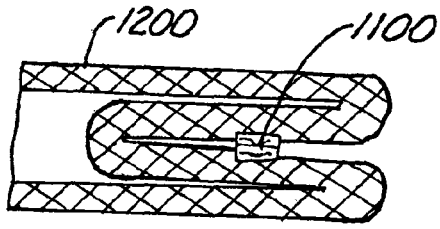
FIG. 18 is a detail view showing side B exposed of a fastener used to hold the reversible, convertible garment in a folded configuration.

The coat or jacket 100 is shown in a semi-folded configuration in FIGS. 15–16 with side B 1200 exposed. At least one pocket 800 is included and a particular application thereof is the optional storage of the handle 110 when not in use as shown in FIG. 17 (in FIG. 17 pocket shown with side B 1200 exposed). Another feature of the jacket or coat 100 are fasteners 1100 as seen in FIG. 18 (jacket folded with side B 1200 exposed). The fastener holds a fold in the jacket or coat 100 while the jacket or coat 100 is in the cushion configuration. Acceptable fasteners comprise snaps and hook and loop fasteners.

The rear view of the jacket or coat (FIG. 16) shows the loop portion 140 of the hook and loop fasteners used to attach the handle 110 when the jacket or coat is folded into its cushion configuration. The jacket is folded along a horizontal line halfway between the upper and lower sets of loop fasteners 140, and the straps 130 wrapped around the shoulders and lower edge of the garment 100 to attach the hook fasteners 150 on the handle straps 130 to the loop fasteners 140 on the jacket 100.

Figure 16A:
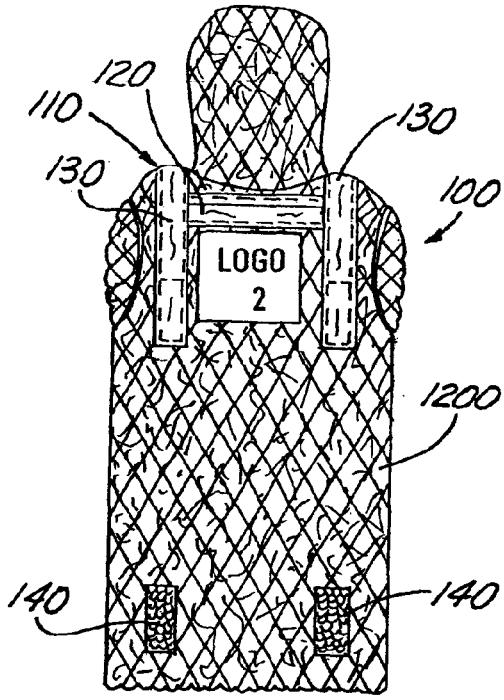
FIG. 16*a* is a rear elevation view of the reversible, convertible garment in a jacket/coat configuration showing side B exposed with the handle stowed at the shoulders.

The second option for stowing the handle 110 when the garment 100 is worn as a coat orjacket is depicted in FIG. 16*a* where side B 1200 of the coat orjacket 100 is exposed to the outside. The straps 130 for the handle are attached as usual to the rear fasteners. The other end of the handle straps 130 are attached to front loop fasteners 810 located in the region of the collarbone on the front of the jacket 100.

The above embodiments are the preferred embodiments, but this invention is not limited thereto. It is, therefore, apparent that many modifications and variations of the present invention are possible in light of the above teachings. It is, therefore, to be understood that within the scope of the appended claims, the invention may be practiced otherwise than as specifically described.

I claim:

1. A reversible, convertible stadium coat comprising:

(a) a garment, foldable into a substantially rectangular parallelepiped shape, having a front, back, sides, top, an open bottom and a first and second surfaces, either of said surfaces being exposed to an outside of said garment at any given time, the top having closed shoulders thereon and an opening therebetween for receiving a wearer's head;

(b) a pair of straps made to extend over each shoulder;

(c) a strap fastener attached to one side of each end of each of said straps;

(d) a pair of first fasteners attached to a lower portion of the back on the first surface for receiving respective strap fasteners, and a pair of second fasteners attached to a top portion of said back on the first surface, one just below each shoulder, for receiving respective strap fasteners, hereby holding the coat in the folded position when said strap fasteners are attached to said pair of first and second fasteners when the first surface is exposed to the outside of the garment;

(e) a pair of third fasteners attached to a lower portion of the back on the second surface for receiving respective strap fasteners, and a pair of fourth fasteners attached to a top portion of said back on the second surface, one just below each shoulder, for receiving respective strap fasteners, hereby holding the coat in the folded position when said strap fasteners are attached to said pair of third and fourth fasteners while the second surface is exposed to the outside of the garrnent; and (f) a handle attached at each end thereof to an intermediate portion of each of the straps for providing a handle when the coat is in the folded position thereof, useful when either surface is exposed to the outside of the garment.

2. The stadium coat of claim 1 wherein said fasteners are comprised of hook and loop fasteners.

3. The stadium coat of claim 1 wherein said fasteners are comprised of snaps.

4. The stadium coat of claim 1 wherein said fasteners comprise ties.

5. The stadium coat of claim 1 wherein the handle comprises:

(a) a fabric pouch; and (b) a fastener for securing contents of said pouch.

6. The stadium coat of claim 5 wherein the fabric pouch folds in half along a line substantially perpendicular to the straps, said handle additionally comprising fasteners to secure the handle in a folded position.

7. The stadium coat of claim 5 wherein the fastener comprises hook and loop fasteners.

8. The stadium coat of claim 1 wherein said coat includes sleeves and a hood.

9. The stadium coat of claim 1 additionally comprising a pair of fifth fasteners, attached to a top portion of said front on the first surface, one just below each shoulder, for receiving respective strap fasteners of the handle for convenient storage of the handle when the stadium coat is worn as a coat.

10. The stadium coat of claim 1 additionally comprising a pair of sixth fasteners, attached to a top portion of said front on the second surface, one just below each shoulder, for receiving respective strap fasteners of the handle for convenient storage of the handle when the stadium coat is worn as a coat.

11. A method of providing a handle for a reversible stadium coat that is convertible to a cushion, said handle being used to carry the stadium coat in its cushion configuration, the stadium coat comprising a first and a second surface, one surface being substantially exposed to an outside of the stadium coat at all times, a first pair of fasteners on the first surface on a back of the stadium coat near shoulders thereof, a second pair of fasteners on the second surface on a back of the stadium coat near shoulders thereof, a third pair of fasteners on the first surface on a back of the stadium coat near a bottom thereof, a fourth pair of fasteners on the second surface on a back of the stadium coat near a bottom thereof, the handle comprising two straps, each having a fastener at each of its ends, and a cross member disposed at the middle of the straps, the method comprising:

(a) choosing which of the two stadium coat surfaces to expose to the outside of the stadium coat;

(b) fastening first two ends of the straps of the handle to the two fasteners on the back of one of the chosen surfaces of the stadium coat near the shoulders of the stadium coat; and (c) fastening second two ends of the straps of the handle to the two fasteners on the back of the chosen surface of the stadium coat near the bottom of the stadium coat.

12. The method of claim 11 wherein the fasteners are hook and loop fasteners.

13. The method of claim 11 wherein the fasteners are snaps.

14. The method of claim 11 wherein the fasteners are ties.

15. The method of claim 11 wherein the cross member on the handle may be used as a storage space.

* * * * *